US008443764B2

(12) United States Patent
Herstad et al.

(10) Patent No.: US 8,443,764 B2
(45) Date of Patent: May 21, 2013

(54) ARRANGEMENT FOR THE ADJUSTMENT OF EQUIPMENT FOR A BOILER

(75) Inventors: Ola Herstad, Gothenburg (SE); Robert Tillander, Grabo (SE); Henrick Lindell, Gothenburg (SE); Bengt Nilsson, Savedalen (SE); Timo Vulli, Gothenburg (SE)

(73) Assignee: Metso Power AB, Goteborg (SE)

( * ) Notice: Subject to any disclaimer, the term of this patent is extended or adjusted under 35 U.S.C. 154(b) by 859 days.

(21) Appl. No.: 12/593,076

(22) PCT Filed: Mar. 17, 2008

(86) PCT No.: PCT/SE2008/050297

§ 371 (c)(1), (2), (4) Date: Nov. 13, 2009

(87) PCT Pub. No.: WO2008/118071

PCT Pub. Date: Oct. 2, 2008

(65) Prior Publication Data

US 2010/0139580 A1 Jun. 10, 2010

(30) Foreign Application Priority Data

Mar. 28, 2007 (SE) ..... 0700763

(51) Int. Cl.
*F22B 37/24* (2006.01)

(52) U.S. Cl.
USPC ..... 122/510; 122/451 R; 122/23; 122/390

(58) Field of Classification Search
USPC ..... 122/451 R, 23, 390, 510
See application file for complete search history.

(56) References Cited

U.S. PATENT DOCUMENTS

| | | | | | |
|---|---|---|---|---|---|
| 2,138,278 | A | | 11/1938 | Kernin | |
| 2,161,111 | A | * | 6/1939 | Wilcoxson et al. | 239/227 |
| 2,541,695 | A | | 2/1951 | Gangewere | |
| 3,215,099 | A | * | 11/1965 | Coulter, Jr. | 110/238 |
| 3,421,462 | A | * | 1/1969 | Wessberg | 110/238 |
| 3,795,475 | A | * | 3/1974 | Hellstrom | 431/1 |
| 4,302,179 | A | * | 11/1981 | Pont | 431/189 |
| 4,416,422 | A | * | 11/1983 | Tinnis | 239/455 |
| 4,453,501 | A | * | 6/1984 | Hayes et al. | 122/510 |
| 4,653,730 | A | * | 3/1987 | Wunsche et al. | 266/47 |
| 5,001,992 | A | * | 3/1991 | Higgins et al. | 110/182.5 |
| 5,494,004 | A | * | 2/1996 | Hunter, Jr. | 122/395 |
| 5,551,354 | A | * | 9/1996 | Crofut et al. | 110/238 |
| 5,762,005 | A | * | 6/1998 | Parisi et al. | 110/234 |
| 6,035,811 | A | * | 3/2000 | Bude et al. | 122/390 |

(Continued)

FOREIGN PATENT DOCUMENTS

SE 527676 11/2005

*Primary Examiner* — Kang Hu
*Assistant Examiner* — Nathaniel Herzfeld
(74) *Attorney, Agent, or Firm* — Rolf Fasth; Fasth Law Offices

(57) ABSTRACT

The arrangement is for positioning equipment in association with an opening in a boiler wall and has a rotation mechanism that rotates the equipment around a virtual rotation axis that lies within the outer wall of the boiler. During the use of a liquor spreader for the introduction of combustible material, the opening of the liquor spreader is arranged in the virtual center of rotation so that the point at which the combustible material is introduced is retained independently of the angle of rotation. The liquor spreader is united either with a glide device or the guide in the rotation mechanism.

5 Claims, 8 Drawing Sheets

U.S. PATENT DOCUMENTS 6,101,985 A * 8/2000 Bude et al. ..... 122/379
6,283,069 B1 * 9/2001 Bude et al. ..... 122/379
6,478,235 B1 * 11/2002 Soderstrom et al. ..... 239/104
6,578,529 B2 * 6/2003 Hytonen et al. ..... 122/7 R
7,475,645 B2 * 1/2009 Engvall ..... 110/182.5
7,926,747 B2 * 4/2011 Jameel et al. ..... 239/596
7,988,820 B2 * 8/2011 Tanttu et al. ..... 162/31
8,276,528 B1 * 10/2012 Higgins et al. ..... 110/111
8,277,721 B2 * 10/2012 Shver ..... 266/216
2003/0075843 A1 * 4/2003 Wunsche ..... 266/225
2004/0123813 A1 * 7/2004 Haaga et al. ..... 122/235.12
2005/0263108 A1 * 12/2005 Engvall ..... 122/7 R
2009/0044765 A1 * 2/2009 Mussmann et al. ..... 122/390
2010/0206965 A1 * 8/2010 Gibowski ..... 239/587.5

* cited by examiner

ARRANGEMENT FOR THE ADJUSTMENT OF EQUIPMENT FOR A BOILER

PRIOR APPLICATION

This application is a U.S. national phase application based on International Application No. PCT/SE2008/050297, filed 17 Mar. 2008.

TECHNICAL AREA

The invention relates generally to equipment for boilers with combustion arrangements for liquid fuel, and it has primarily been developed to be used for the combustion of black liquor in soda boilers or in other furnaces for the processing of spent liquor. The invention thus hereby concerns an arrangement for the adjustment of equipment that is associated with the boiler, which equipment can be introduced through a boiler wall.

It is preferable that this arrangement comprises an adjustment of a spreader unit with a nozzle at the forward end of the unit for the distribution of a liquid fuel into a furnace in a boiler. The concept of "boiler" is hereby to include combustion ovens in general. The equipment may also relate to rodding arrangements, soot blowers, cameras or other protective equipment that is to be positioned in the boiler or in the vicinity of its opening.

BACKGROUND AND SUMMARY OF THE INVENTION

In a soda boiler, combustion liquor, normally black liquor, is supplied to the furnace through spreaders into the boiler (the reactor). Air is added at the same time, at several levels. Drying, evaporation, vaporisation, combustion, pyrolysis and several other processes that the liquor undergoes take place not only in the liquor and in the volume of gas formed, but also in and above the roasting bed. Since it is ideally the case that these processes take place in local trajectories, comprising different processes in different local volumes, rather than a mixture of processes in a global volume, with as similar processes as possible in all local volumes, careful control of each input control variable is of the utmost importance. Of the three main variables relating to operation that can be influenced—the supply of combustion air, the distribution of liquor (i.e. the location in the reactor at which liquor is supplied), and the spread of the liquor (i.e. the manner in which the liquor is supplied and distributed inside the reactor), the present invention relates to the spread of the liquor.

The atmosphere within the furnace is heavily corrosive for all equipment in the furnace environment, in particular given that the atmosphere also is rapidly changing. Thus, alternation between an oxidising atmosphere and a reducing atmosphere takes place in a soda boiler, combined with a high-temperature environment with attack by an alkali smelt. The lifetime for such items as liquor spreaders, therefore, is normally counted in weeks, rather than months. A well-defined and unchanging localisation of critical components of the spreader is necessary in order to obtain a controlled and longer lifetime. Arrangements and measures in order to protect these critical components are effective only for very small, well-defined volumes, mainly as a result of the chaotic nature of the flow patterns in the furnace and the severe aggression of the thermochemical attack. The difficulties of protecting the said critical components of the spreader are not made any less by the fact that the shortest distance between the inner surface of the furnace and the mechanical equipment outside of the boiler cannot be made shorter than approximately 0.5 m due to the wall of a modern soda boiler (reactor) consisting of high-pressure tubes on the inside, protective walls, insulation and external cladding, which all together give the significant thickness of wall.

These conditions—the aggressive atmosphere and the geometrical limitations—apply also for other equipment in a soda boiler, such as mechanical cleaning equipment, soot blowers, and other flow-based cleaning equipment, together with furnace cameras and other sensors. The present invention can be used also for such equipment.

Similar conditions are present also in other combustion equipment, even if the severe chemical attack is lacking in such combustion equipment. The invention can therefore be used in such other combustion equipment such as, for example, equipment for the combustion of biofuels, bubble bed furnaces, circulating fluidising bed furnaces, and in certain other reactors, such as that used to roast iron pyrites.

The spreader according to prior art technology, which is described in, for example, SE 527676, can be rotated in the vertical direction around horizontal axes, centres of rotation, or pivots outside of the reactor wall. When rotating the spreader unit around such axes, centres of rotation or pivots outside of the reactor wall, the angular position of the spreader nozzle inside the furnace changes at the same time, as does its height and its distance from the wall. Due to the thickness of the wall, this means also that the region, or the volume, within which the spreader nozzle moves is large, and this in turn means that deviations from the ideal positioning of the spreader nozzle and the ideal pattern of spread will be significant, while at the same time the possibility of efficiently protecting the spreader is significantly made more difficult, or made impossible.

It may be desirable during operation of the boiler also to introduce other equipment into the boiler through openings in the boiler wall.

It may be desired to introduce, for example:

- rodding arrangements, which are used to mechanically remove by poking deposits in association with openings or located on surfaces inside the boiler in association with the opening, or
- soot blowers, which are introduced into the interior of the boiler in order to force with the aid of pressurised air, steam or explosive charges deposits to be released either from walls of the boiler or from tubes inside the boiler, or from both, and
- camera equipment, which is introduced for inspection, and
- various protective arrangements such as screens or cooling equipment.

The introduction of such equipment requires a hole to be made in the boiler wall, where the construction of the boiler wall must be altered around the hole, and in those cases in which tubes are integrated into the wall it is necessary to reroute these, giving high costs. It is therefore desirable that the opening in the wall be made as small as possible, such that as few tubes as possible in the boiler wall need to be rerouted.

The aim of the invention is to deal with the set of problems described above. This aim can be achieved through the equipment that is to be introduced into the boiler through an opening in the boiler wall, preferably a nozzle for the distribution of liquor, being such that it can be directed into different angular positions through rotation around a virtual centre of rotation located within the outer surface of the boiler wall.

Since the equipment that is to be introduced or positioned is a nozzle for the distribution of black liquor, this virtual centre of rotation is arranged to coincide with the position from which the fuel is spread adjacent to the opening of the nozzle into the furnace, or in an opening into the boiler. It is preferable that the said virtual centre of rotation is constituted by an imaginary horizontal line, which remains stationary during rotation of the nozzle. It is characteristic of the invention that also the said virtual centre of rotation lacks an axis in its physical meaning in the region of the said centre of rotation in the form of a machinery component that is arranged to be stationary or to rotate and that is supported by bearings.

The particular equipment that is to be positioned in the opening of the boiler is, in the embodiments that are described below, a spreader nozzle for black liquor or fuel. This spreader nozzle is arranged at the outlet of a pipe, denoted a "spreader pipe" below, that extends through an opening in a boiler wall.

The invention has its principal application in soda boilers, where facilitation of protective measures for the critical components of the equipment supplements the process technical advantages of being able to orient the equipment, preferably the nozzle, in different angular positions by rotating it around a centre of rotation inside the reactor or at the level of the boiler wall. The process technical advantages of having better control dominate in other combustion equipment and reactors. Among a number of clear advantages that can be achieved with the location of the centre of rotation at a well-defined and essentially unchanged position within the wall of the reactor offered by the present invention, the following can be mentioned:

- The distance of the spreader nozzle to the closest boiler wall does not change when the spreader unit is rotated, and this reduces the risk of the splashing of combustion liquid (liquor) onto the wall, during large changes of angle. This provides not only a gain in efficiency, but also an increase in safety. Liquor or other combustion liquid that runs down the wall may under disadvantageous conditions give rise to an explosion in the boiler.
- A fixed position of the nozzle that is independent of the angle of rotation makes it also possible to limit the protection of critical components of the spreader from mechanical, thermal and chemical attack to a smaller area, and thus makes this simpler or more efficient, or both.
- The spreader nozzle and the pattern of spread from the nozzle remain stationary relative to fixed supply points for combustion air and relative to the fixed position of the bed at the bottom of the furnace.
- If it is necessary to adjust the height of the spreader nozzle, this can be carried out as a separate measure that does not affect the angular setting of the spreader nozzle.
- It becomes easier to calculate the combustion process in the reactor if the position of spread is fixed. Nearly all currently used calculation procedures assume in practice that this condition is true, and this is thus a false assumption when using currently available technology.
- The opening that is required in the boiler wall for the front part of the spreader unit, comprising at least the actual spreader nozzle itself, to reach inside of the reactor can be made smaller, and this leads to, among other results, considerably lower costs for the rerouting of tubes in the wall of the boiler.
- A well-defined positioning of the spreader nozzle in the furnace gives also the possibility for the use of remote monitoring of the distribution, of flame-watch type used in burners. Such remote monitoring may be of major significance for preventing, for example, water-smelt explosions due to a failure of the combustion liquid (the liquor) to be distributed and thus meeting the bed in a collected stream, as a result of erroneous function.
- It is not necessary to decrease the angular setting of the spreader nozzle from a large angle before it is possible to withdraw the unit from its operating position to its maintenance position, such as may be necessary according to prior art technology, in order to prevent a component of the equipment colliding with the boiler wall.
- A smaller amount of cooling agent is required to cool, and thus protect, critical components of the spreader equipment, than that required with prior art technology, and this means that disturbance to the combustion process as a result of the supply of large quantities of cooling agent can be avoided.
- Displacement of the equipment between its operating position (within the furnace) and its maintenance position (fully or partially withdrawn) is facilitated in that it is not necessary to check whether the spreader unit is located at a position that is approved for its withdrawal or introduction. Not only manual methods but also remotely controlled equipment can be used while retaining safety. The same functional advantages are achieved, independently of whether the displacement takes place to and from the operation position along a straight line using wheeled transport or along rails, or through any form of curved movement based on linkage arms, shafts or other machinery components.

Other characteristics and aspects of the invention and its advantages are made clear by the non-independent claims, and by the following description of some embodiments.

DETAILED DESCRIPTION

Reference will be made in the following description of some putative embodiments to the attached drawings, of which:

FIG. 1 illustrates schematically the fundamental principle of the invention, FIG. 2 illustrates how the principle according to FIG. 1 can be realised, whereby the drawing shows a view in perspective of equipment according to a first embodiment of the invention, comprising a spreader unit in its operating position in a soda boiler, of which a part of the boiler wall is shown, FIG. 3 shows the equipment according to FIG. 2 in a view seen obliquely from below, FIG. 4 illustrates how a spreader unit can be rotated through a certain angle of rotation relative to a fixed member of the equipment according to the embodiment according to FIGS. 2 and 3 around a centre of rotation in the region of the opening of a spreader nozzle in the forward end of the spreader unit, FIG. 5 illustrates schematically the equipment and the function of the first embodiment of the invention according to FIGS. 2-4, FIG. 6 illustrates how the spreader unit can be rotated according to a second embodiment around the same centre of rotation as that according to the first embodiment, and FIG. 7 illustrates how the rotation of the spreader unit can be carried out according to a third embodiment, FIG. 8 illustrates how the rotation of the spreader unit can be carried out according to a fourth embodiment, partially freed, FIG. 9 illustrates a lower position of the rotation in the fourth embodiment, FIG. 10 illustrates an upper position of the rotation in the fourth embodiment.

DESCRIPTION OF SOME PREFERRED EMBODIMENTS

The equipment according to the invention comprises, for example, a spreader unit, which has been given the general reference number 2 in FIG. 1, for the distribution of combustion liquor to a soda boiler. A part of the tubular wall 3 of the soda boiler is shown, this part being a unit of high-pressure tubes, together with a thick protective wall and insulation, given the general reference number 4, outside of the tubular wall, and an external cladding 8. An opening 5 extends through the boiler wall; this opening is surrounded by a protective cladding 9 of non-combustible material. A furnace on the inner surface of the tubular wall 3, i.e. to the right in FIG. 1, has been given the reference numeral 7. FIG. 4 shows in more detail how the spreader unit illustrated schematically in FIG. 1 is constructed. This consists, according to the embodiment, of a tubular injector body 10, a connecting pipe 11 connected to the injector body 10, the forward end part 37 of which pipe 11 is angled obliquely downwards, a spreader nozzle 12 arranged at the end of this angled part 37 and a spreader plate 13 arranged under the spreader nozzle 12, which is, actually, of previously known type. The injector body 10 and the connecting pipe 11 will be denoted in this text jointly as a "spreader pipe" 14. A flexible steel tube 15 for the supply of combustion liquor is connected to the rear end of the injector body 10, i.e. to the end of the spreader pipe 14.

To return now to FIG. 1, the spreader unit 2 in its operating position has been introduced through the opening 5 to such an extent that the spreader nozzle 12 is located in the furnace 7 inside of the tubular wall 3, or possibly, at the same level as the wall. What is particularly characteristic for the invention is that the spreader unit 2 can be rotated in a vertical plane around a centre of rotation 27 in the furnace 7, which centre of rotation has the form of an imaginary horizontal line that extends through a point in the region of the opening of the spreader nozzle 12.

Reference is now made to FIGS. 2 and 3, which show equipment according to the invention generally denoted by reference number 1. This includes the spreader unit 2, which has been described above with reference to FIG. 4, and which comprises a spreader pipe 14. A pneumatic cylinder 17 is arranged under the spreader pipe 14. The cylinder 17 is united with the spreader pipe 14 through a coupling 18 in a manner that allows its removal. A cleaning device is present at the end of the piston rod 19 of the pneumatic cylinder 17, in the form of a poker (not shown in the drawings) used to hack away slag and other deposits from the spreader unit in association with at least one of the nozzle 12 and the spreader plate 13. Other equipment with operative functions within the boiler, such as a furnace camera and other sensors, can be attached in a similar manner to the spreader pipe 14.

A support for the spreader unit 2 has the form of a bracket 20, which supports two horizontal guides. The bracket 20 with the guides 21 is attached to and extends from the boiler wall under the opening 5. A carriage 24 is arranged on the guides 21 such that it can be displaced. Two parallel, vertical guide plates 25 are united with the carriage by welding or by another permanent manner, and extend from approximately the level of the pneumatic cylinder 17 towards the plane of the floor. A guide track 26 with the form of an arc of a circle is present in each guide plate 25—such a guide plate 25 is shown also in FIG. 4. The radial centre of a guide track is located at the said point in the centre of the opening of the spreader nozzle 12, which point is also the centre of rotation 27 for the spreader unit 2.

A steel construction 30 is located under the pneumatic cylinder 17 in the form of a box arranged between the guide plates 25. The box 30 is united with the spreader unit 2 through the pneumatic cylinder 17. A pair of horizontal shafts 32, 33 extend through the box 30. The shafts 32, 33 are so mounted in the box 30 that they are coaxial with a pair of double-flanged wheels 34, 35, which have been introduced into the guide track 26 that is present in each of the guide plates 25.

The mechanical arrangements that have been described function in the manner that will now be described with reference to FIGS. 1-5, when the spreader unit 2 has been introduced into its operating position. When the spreader unit 2 is in its operating position, FIGS. 1 and 2, the spreader nozzle 12 is located inside the furnace chamber 7 a short distance inside of the tubular wall 3, or possible at the same level as this wall. The spreader plate 13 is essentially horizontal in this position, and a forward part 37 of the connecting pipe 11 is directed downwards towards the spreader plate 13 at a fixed angle to it in a manner that is known. If it is desired to direct the forward part 37 of the spreader pipe in a more downwards direction and to angle at the same time the spreader plate 13 also downwards, the spreader pipe 14 is moved upwards, which it would be possible in principle to carry out manually with the aid of the handle 39 on the upper surface of the spreader pipe 14. A displacement means 48, however, is available, in the form of a screw arranged between the fixed and rotating parts of the equipment 1 when in its operating position. According to the embodiment, the screw extends between a horizontal rod 36 located at a lower rear corner of the box 30 and a horizontal rod 38, FIG. 3, that extends between a pair of brackets on the carriage 24. The lower end of the screw 48 may be attached to the box 30 in a manner that allows displacement, and introduced into the rod 38 through a hole with a corresponding thread for a nut. Alternatively, the screw 48 can be constituted by a stretching screw that is united with matching left and right-threaded holes in the rod 38, and with the rod 36 in the box 30. A knob 42 is located at the rear upper end of the screw 48.

The lower rear corner of the box is drawn, through rotating the knob 42 in a certain direction, backwards and upwards, taking with it the shafts 32, 33, and thus also the wheels 34, 35, which are compelled to follow the guide tracks 26 in the plates 25, which are fixed relative to the carriage 24. The compels the wheels 34, 35 and the shafts 32, 33 to move along the arc of a circle that has its centre in the said centre of rotation 27 in the region in which the opening of the spreader nozzle 12 is located, and this in turn compels the complete spreader unit 2, and any arrangements that may be connected to the spreader unit, such as the pneumatically operated cleaning device, to rotate around this centre of rotation 27. When the desired angle of rotation has been reached—the maximum angle of rotation according to the embodiment is $\alpha°$, FIG. 4,—the spreader unit 2 can be fixed in its new position by locking the screw 48 with a conventional lock device, such as a locking nut.

FIG. 5 illustrates in schematic form the principle of the embodiment according to FIGS. 2-4. The drawing illustrates that the displacement means 48, which in the detailed embodiment is constituted by a screw, can be arranged at a freely chosen location between the fixed units, which are represented by the plates 25 and the tubular injector body 10.

The mechanical arrangements described are basically so simple that a precision can be achieved that is sufficient to ensure that the location of a horizontal central line in the opening of the spreader nozzle 12 moves to an insignificant degree as a result of the rotational movement of the spreader unit 2 that has been described. The maximum deviation from the theoretical centre of rotation 27 can lie within the area of a circle with its centre at the said theoretical centre of rotation and having a maximum radius of 2 cm, and preferably a maximum radius of 1 cm.

In one variant of the embodiment that has been described with reference to the drawings 2-5, a pair of segments of toothed wheels can be used instead of a pair of guide tracks having the form of an arc of a circle. These segments may be united with the spreader pipe 14. A box or another rigid construction can be arranged between a pair of such segments of toothed wheels, which construction is attached to the carriage 24. A horizontal shaft can in this case extend through the box, mounted in bearings in the box, and which supports on each side of the box a securely wedged toothed wheel that interacts with the relevant segment of toothed wheel. The relevant segments of toothed wheel form, in the same manner as the guide tracks in the preceding embodiment, a pair of arcs of a circle, the radial centre of which coincides with the said centre of rotation 27, which is constituted by a putative horizontal line in the region of the opening of the spreader nozzle 12. By rotating the said toothed wheels, which can be carried out with the aid of a hand crank or with the aid of an electric motor through a suitable transmission, the complete spreader unit 2 is rotated in a manner that is equivalent to the function of the preceding embodiment.

There are two centres of rotation in the embodiment according to FIG. 6: not only the said centre of rotation 27 in the region of the opening of the spreader nozzle 12 (which centre of rotation constitutes a first centre of rotation in the movement system), but also a second centre of rotation 50, which is parallel with the said first centre of rotation 27 and which is located at one member 51, under and united with the spreader pipe 14. The said member 51 can have the form of two parallel plates, united with the spreader pipe 14. A pair of lower plates 52 is united with the spreader pipe 14 through the member 51 through a horizontal shaft 53. The shaft 53 has its centre of rotation coincident with the said second centre of rotation 50. The plates 52, which are mounted in bearings around the shaft 53, can be displaced vertically with the aid of a first displacement means 54, a screw, for example, as it was in the preceding embodiment, and the spreader pipe 14, and with it the complete spreader unit 2, can be rotated around the said second centre of rotation 50 with the aid of a second displacement means 55, which also may be constituted by a screw, arranged between the spreader pipe 14 and the plates 52. A resultant rotation of the spreader unit 2 around the said first centre of rotation 27 can also in this case be achieved by control of the displacement means 54, 55, i.e. the same final result as in the preceding embodiments.

A first fixed pivot support has been given the reference number 60 in the embodiment according to FIG. 7. This has at its upper end a contact means, that may be constituted by a pair of wheels 61. A member under the spreader unit 2, for example a box 62 united with the spreader unit 2, makes contact at its forward surface 63 with the wheels 61 on the support 60. A base link 65 makes contact at its lower end 66 with the lower end 60 of the support, in a manner that allows rotation. A pair of links 67, 68, which are not parallel with each other, are united not only with the base link 65, but also with the box 62, in a manner that allows rotation. The manner of this uniting is illustrated in FIG. 7. The link 66 is united at the positions 68 and 69 with the base link 65 and with the box 62 in a manner that allows rotation, and in an equivalent manner the link 67 is united at positions 70, 71 with the base link 65 and the box 62, in a manner that allows rotation. The centres of rotation 68, 69, 70, 71 for the said pivot positions form the corners of a quadrilateral that is not constituted by a parallelogram. The displacement means for lifting or lowering the base link 65 is symbolically represented in the drawing by the double arrow 73. Through selection of the lengths of the links and the relative distances between the pivot points 68-71, it is possible to achieve a pattern of movement in which the wheels 61 roll against the side 63 of the box 62, and this gives the same final result with respect to the rotation of the spreader unit 2 around the said centre of rotation 27 as in the preceding embodiments.

An alternative embodiment is shown in FIG. 8 that differs from the embodiments shown in FIGS. 2-5 in that the circular guidance is constituted by a bent guide beam **26*b* instead of a guide track. The guide beam 26*b* is an integral part of a fixture 20*b* that is rigidly fixed to the bracket or to the carriage that slides along the bracket. The liquor spreader is attached in a suitable manner to the upper parts of two rails 25*b*, which rails are arranged one on each side of the guide beam 26*b* (only one of the rails 25*b* is shown in FIG. 8). Guide rollers 34*a* (two rollers) and 35*b* are arranged between these rails, where two of the guide rollers 34*a* are located on the convex side of the guide beam 26*b*, while one guide roller is located on the concave side of the guide beam 26*b***. The guide beam has been provided in a similar manner with a curvature such that it has a centre of curvature that coincides with the virtual centre of rotation.

Figure 1:
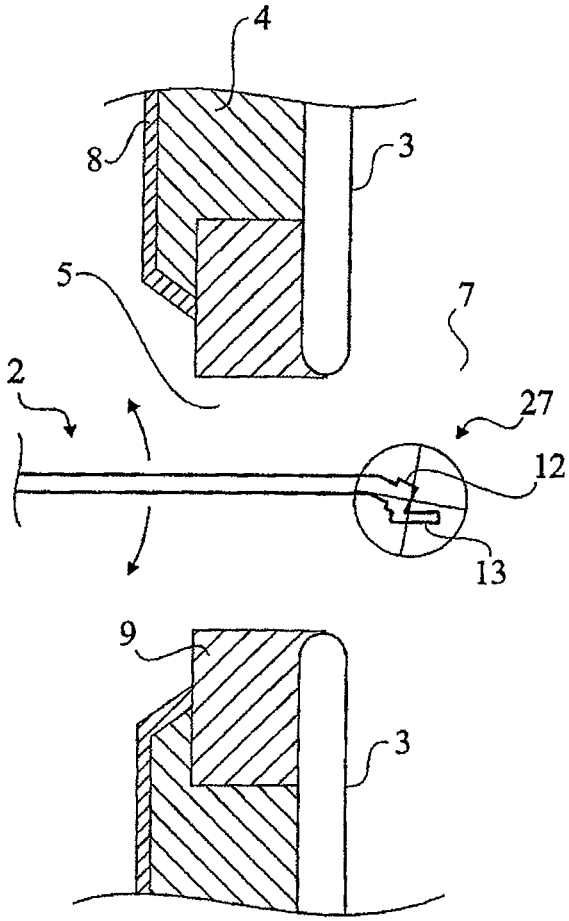
Figure 2:
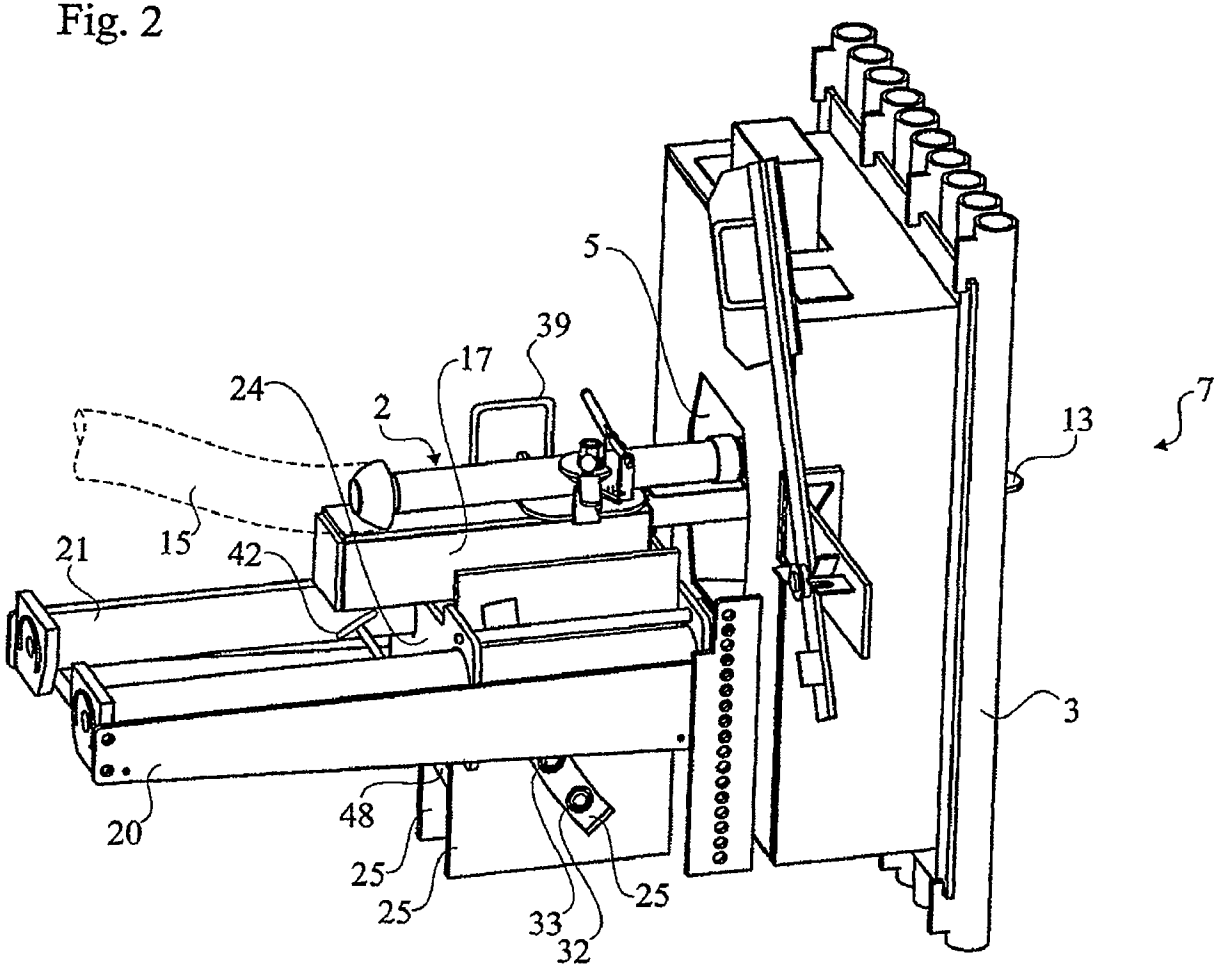
Figure 3:
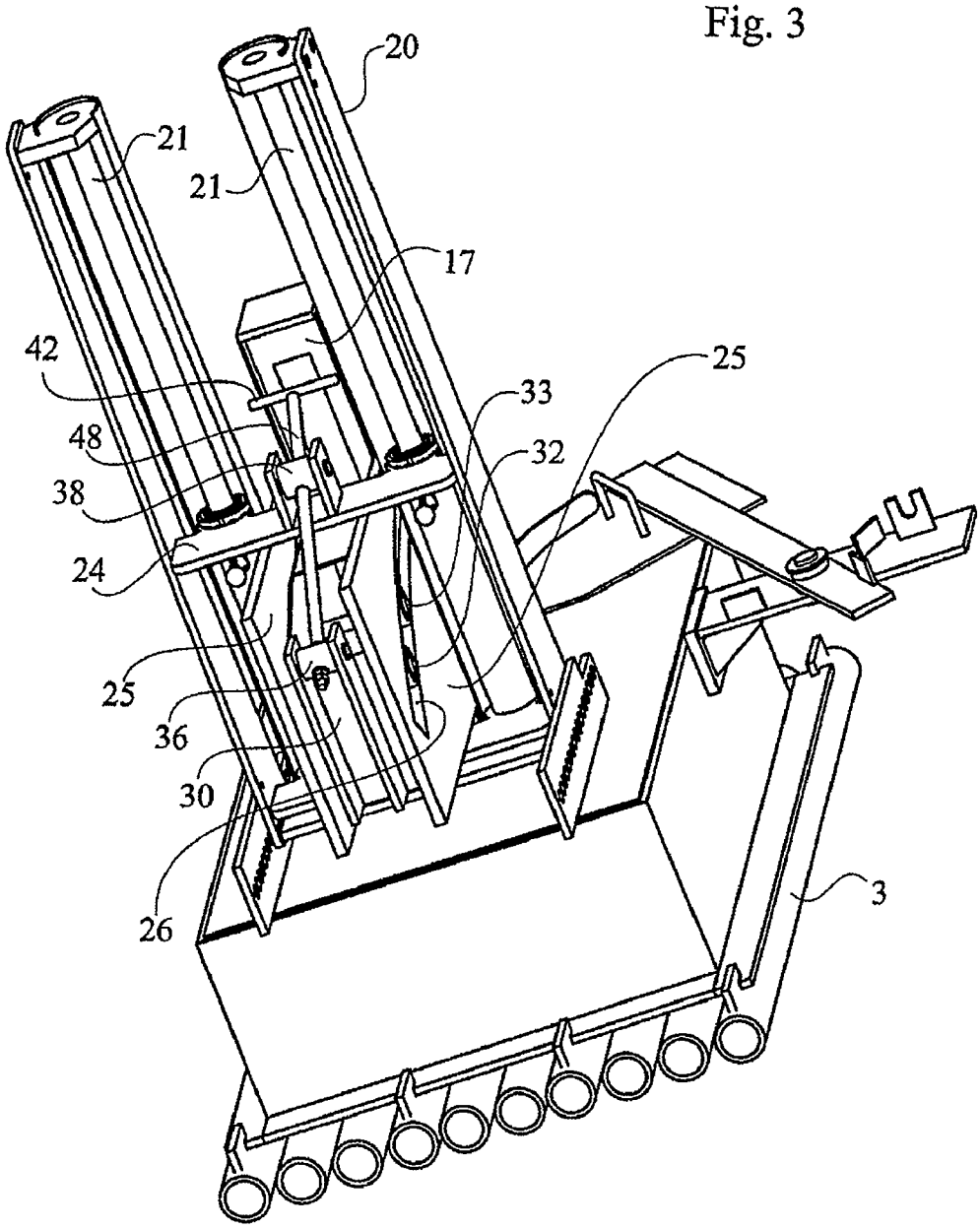
Figure 4:
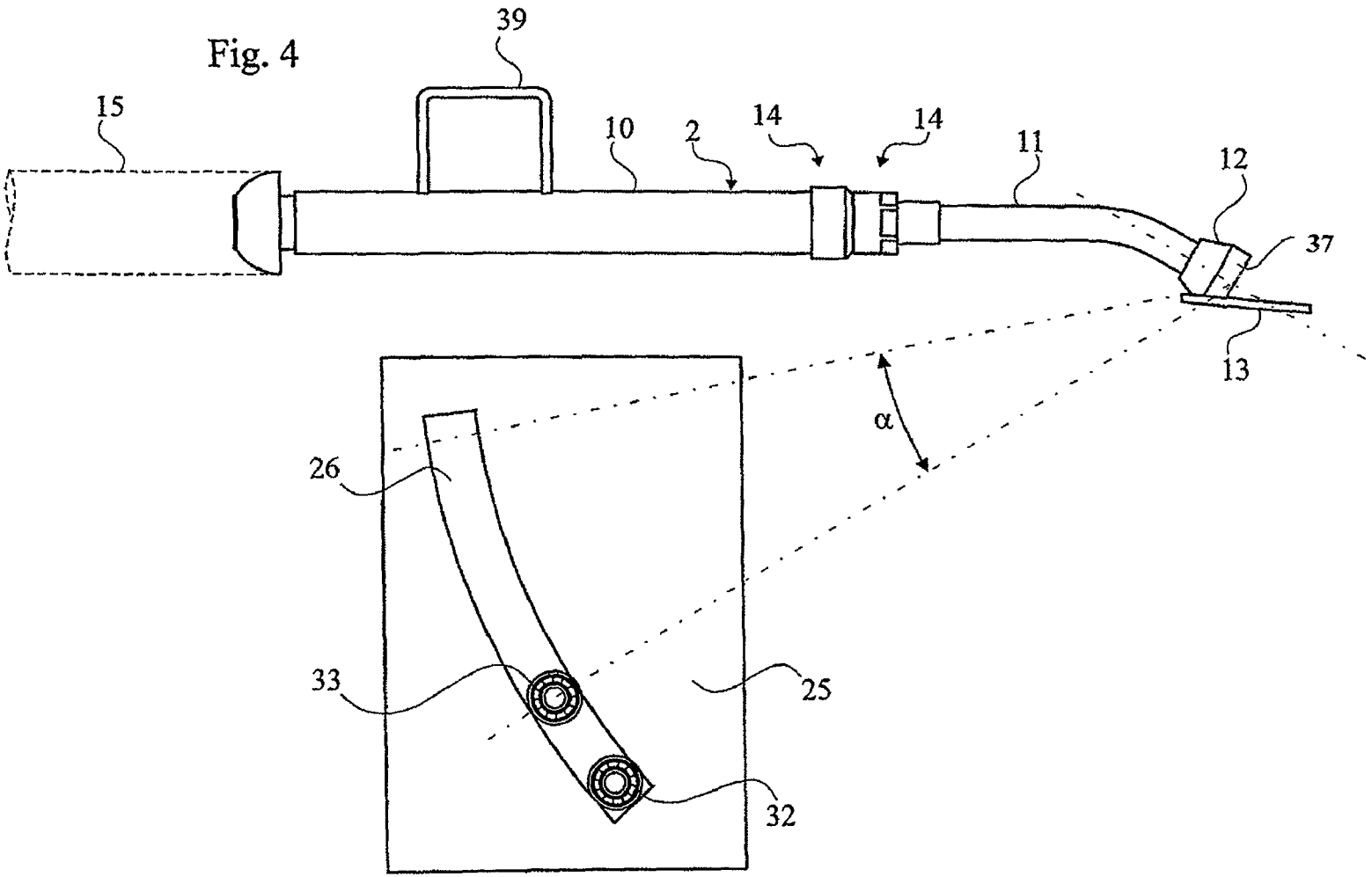
Figure 5:
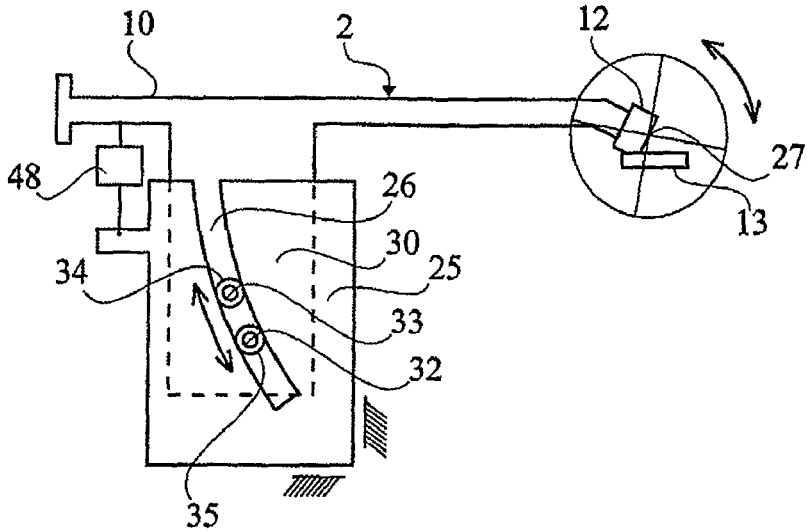
Figure 6:
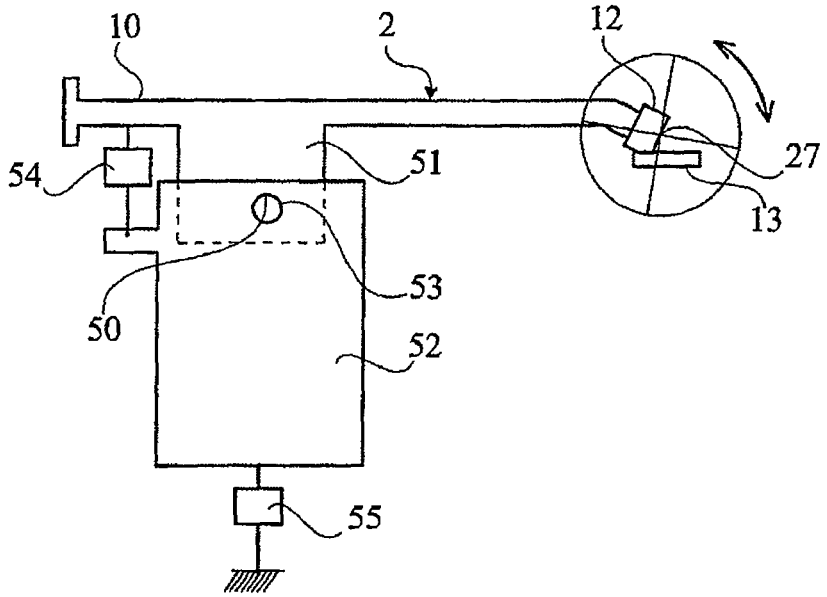
Figure 7:
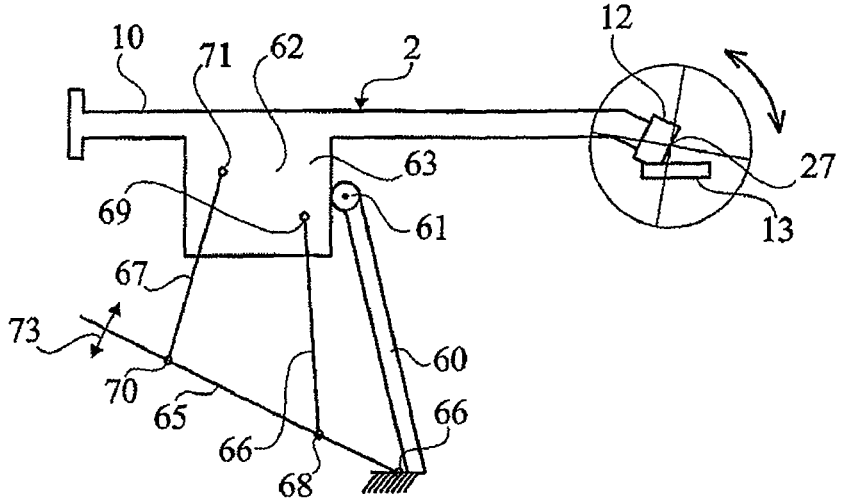
Figure 8:
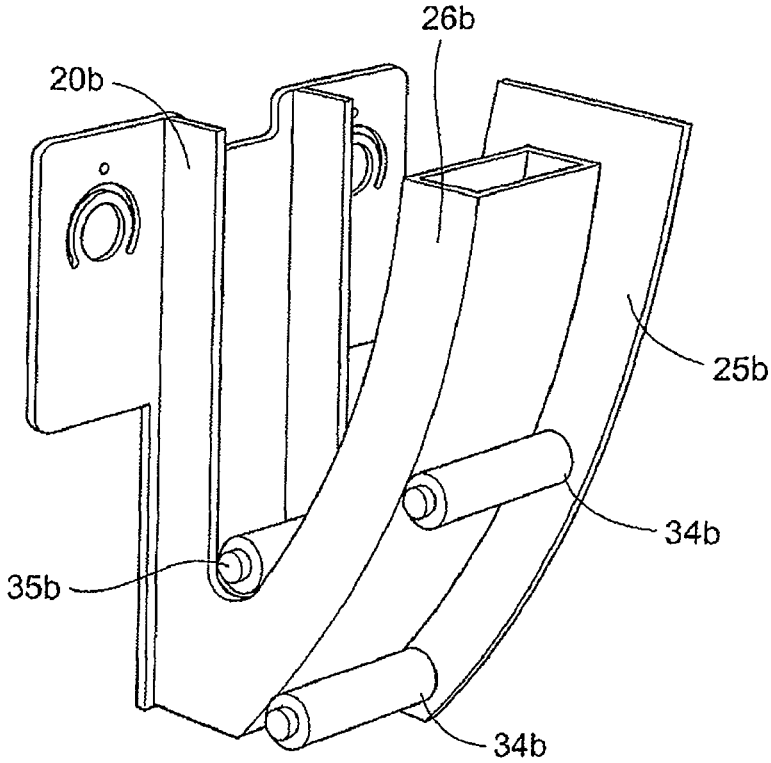
Figure 9:
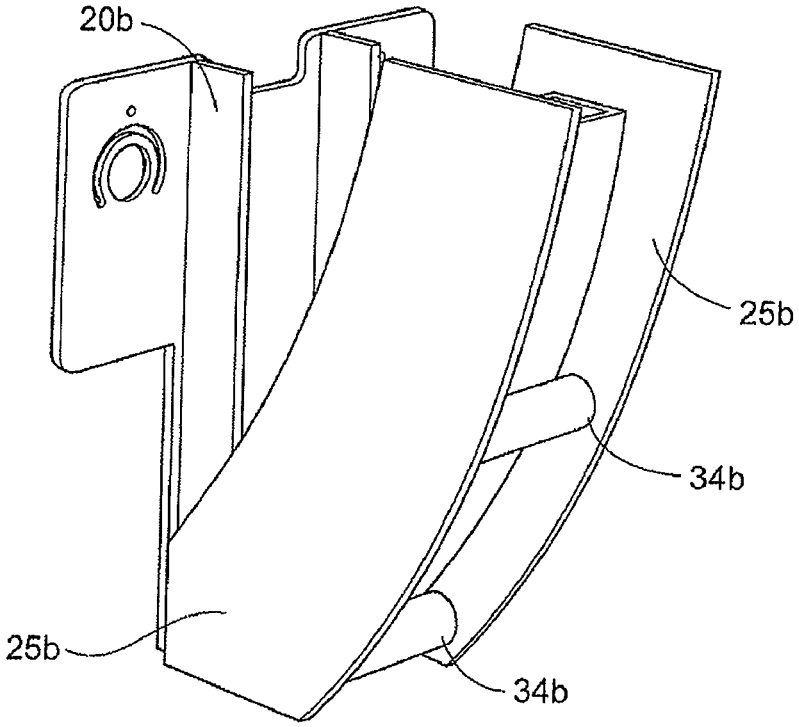
FIG. 9 shows the lower position, equivalent to that shown in FIG. 8, but in this case with the second rail **25*b* mounted in place, such that the axles of the guide rollers are held in position between these rails 25*b***.
Figure 10:
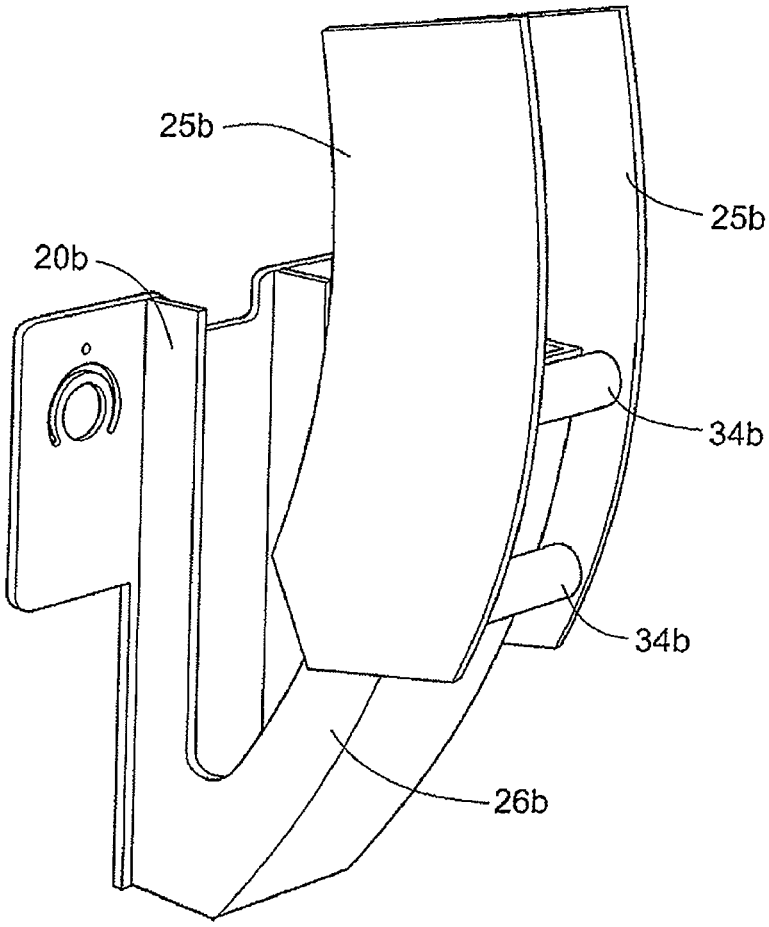
FIG. 10 shows a position at which the rails, and thus also the equipment that is to be positioned and that is united with these rails, displaced upwards on the guide beam.

Characteristic for all of these embodiments is that the rotation mechanism is constituted by simple physical guiding of the liquor spreader during its rotation in the vertical plane, i.e. an adjustment of one degree of freedom using the rotation mechanism. These rotation mechanisms can subsequently be combined as necessary with other simple adjustment mechanisms that control other degrees of freedom such as, for example:

- the height of the complete equipment, i.e. a degree of freedom that entails a parallel displacement in the vertical direction, or
- a simple regulatory mechanism that can rotate the equipment, the liquor spreader, along its longitudinal direction.

It is appropriate that the rotation mechanism be located on a carriage that can be displaced towards and away from the opening of the boiler, on a bracket that is attached to the boiler.

While the present invention has been described in accordance with preferred compositions and embodiments, it is to be understood that certain substitutions and alterations may be made thereto without departing from the spirit and scope of the following claims.

The invention claimed is:

1. An arrangement for an adjustment of equipment for a boiler, which equipment is to be introduced into a furnace through an opening in a boiler wall of the boiler, comprising:

the equipment being directable in angular positions through rotation by a rotation mechanism arranged outside an outer surface of the boiler wall and outside of the furnace, the rotation mechanism having means for rotating the equipment around a virtual center of rotation located within the outer surface of the boiler wall, and the means for rotating the equipment being located entirely outside the outer surface of the boiler wall, the equipment having a spreader unit with a nozzle located at a forward end of the spreader unit for distributing a liquid fuel in the furnace in the boiler, the nozzle being directable in different angular positions by rotating with the rotation mechanism arranged outside of the furnace, the rotation mechanism having means for rotating the nozzle around the virtual center of rotation in a region of a position from which the liquid fuel is spread next to an opening of the nozzle in the furnace or in an opening of a reactor, the rotation mechanism having a first part, fixedly arranged to a bracket and a second part united with a spreader pipe, one of the first part or the second part constituted by a guide having a form of an arc of a circle extending in a plane that is perpendicular to a line constituting the virtual center of rotation at a distance from the virtual center of rotation, the arc having a center at the virtual center of rotation, the second part being constituted by at least two rails or rollers, the two rails or rollers being arranged in, on or in contact with the guide, displacement means being arranged for displacing the two rails or rollers relative to the guide to rotate the spreader pipe and the nozzle around the virtual center of rotation.

2. The arrangement according to claim 1, wherein the first part is designed with the guide.

3. The arrangement according to claim 1 wherein the guide is constituted by a guide track.

4. The arrangement according to claim 1 wherein the guide is constituted by a guide beam.

5. The arrangement according to claim 1 wherein the arrangement has a control device constituted by a segment of a toothed wheel.

* * * * *